US007841573B1

(12) United States Patent
Block

(10) Patent No.: US 7,841,573 B1
(45) Date of Patent: Nov. 30, 2010

(54) DOOR GUARD

(76) Inventor: Michael Block, P.O. Box 64264, Phoenix, AZ (US) 85082

( * ) Notice: Subject to any disclaimer, the term of this patent is extended or adjusted under 35 U.S.C. 154(b) by 0 days.

(21) Appl. No.: 12/431,358

(22) Filed: Apr. 28, 2009

Related U.S. Application Data

(60) Provisional application No. 61/048,502, filed on Apr. 28, 2008.

(51) Int. Cl.
*A47B 95/00* (2006.01)

(52) U.S. Cl. ..... 248/345.1; 49/462; 49/383; 52/211

(58) Field of Classification Search ..... 248/345.1; 52/211, 835; 49/462, 383, 506, 384; 16/224, 16/355
See application file for complete search history.

(56) References Cited

U.S. PATENT DOCUMENTS 4,845,892 A * 7/1989 Pinto ..... 49/383
5,815,998 A * 10/1998 Wamsher ..... 52/211
6,434,888 B1 * 8/2002 Shaw et al. ..... 49/383
6,829,863 B2 * 12/2004 Lovas ..... 52/211
6,931,789 B2 * 8/2005 Stout, Jr. ..... 49/383
7,712,257 B2 * 5/2010 Johnson ..... 49/383

* cited by examiner

*Primary Examiner*—Ramon O Ramirez
(74) *Attorney, Agent, or Firm*—Schmeiser, Olsen & Watts LLP

(57) ABSTRACT

A door guard is disclosed having a protector plate which protects a door and a support which protects a door jam and a door hinge. The protector plate is hingedly connected to the support. The protector plate rotates in response to the door opening when force is applied to the door. The present invention may further include a slide mount assembly which slideably couples the protector plate to a door. Other embodiments of a door guard also protect an overhead door and an overhead door track.

16 Claims, 8 Drawing Sheets

DOOR GUARD

CROSS REFERENCE TO RELATED APPLICATION

This application claims priority to U.S. Provisional Patent Application to Michael Block entitled "DOOR GUARD", Ser. No. 61/048,502, filed Apr. 28, 2008, (now pending), the disclosure of which is hereby incorporated entirely herein by reference.

BACKGROUND OF THE INVENTION

1. Technical Field

This invention relates generally to an apparatus for protecting a door, and more particularly to an apparatus for protecting swinging doors, door jams and hinges from damage from warehouse loading equipment, such as a hand truck or fork lift.

2. State of the Art

There are typically loading-type doors in warehouses and other businesses that have inventory and need to store such inventory in one particular place and move the inventory to another place. In the process of moving inventory, businesses often employ forms of equipment in order to move the inventory due the amount of inventory that must be moved and the weight of the inventory. For example, a fork lift is often employed to lift pallets of inventory and drive them to another location for unpacking, stocking, loading, or for other purposes. These warehouses or buildings often have doors that may be opened in order for a fork lift to drive through.

As fork lifts drive through these doors, the doors are exposed and open to damage. For instance, if the doors inadvertently close as a fork lift is driving through, the door may become damaged; if the fork lift operator misjudges the door opening, the fork lift may hit the door, the door jam or even the hinges of a door, thereby causing damage to the door or rendering the door inoperable.

When the doors are damaged, the ability for proper function is compromised and in order to correct the operation of the damaged doors, the business must replace the door, door jam or hinges. This is costly and inconvenient.

Accordingly, there is a need in the field of doors for a door guard that serves to protect the door, door jam and hinges without impeding the proper function of the doors.

DISCLOSURE OF THE INVENTION

The present invention relates to a door guard that includes a protector plate which protects a door, and a support which supports the protector plate. The protector plate is hingedly coupled to the support. The support is adapted to protect the door jam and hinges. The protector plate rotates in response to the door opening when force is applied to the door. In some embodiments, the door opens in response to rotation of the protector plate when force is applied to the protector plate.

In some embodiments the support is coupled to a floor at one end and is coupled to a wall at another end. A slide mount assembly can be used to slideably couple the protector plate to the door. The slide mount assembly can include a slide rod coupled to the protector plate, a track coupled to the door, and a roller which couples the slide rod to the track.

The present invention provides a door guard, the door guard comprising a protector plate having a first end and a second end, and a support, wherein the first end of the protector plate is hingedly coupled to the support, and the second end of the protector plate is coupled to a door. In some embodiments the first end of the protector plate protects the door jam and a door hinge, and the second end of the protector plate protects the door. The first end of the protector plate and the second end of the protector plate can be formed in angled relationship to one another wherein the first end is flush with the door jam when the door is in an open position and the second end is flush with the door when the door is in an open position. In some embodiments the protector plate extends in a substantially transverse direction from the support. The support can be coupled adjacent a door jam. The protector plate can be adjacent a floor. The first end of the protector plate can be hingedly coupled to the support. In some embodiments the second end of the protector plate is coupled to the door using a slide mount assembly. A slide mount assembly can include a slide rod coupled to the protector plate, a track coupled to the door, and a roller which couples the slide rod to the track. The track can be coupled to a bottom side of a door. The protector plate can rotate in response to the door opening when force is applied to the door. The door can open in response to the rotation of the protector plate when force is applied to the protector plate.

The present invention discloses a method of opening a door which includes contacting a protector plate, applying pressure to the protector plate in a direction towards a door such that the protector plate rotates, and continuing to apply pressure until the door is opened to the desired position. In some embodiments the protector plate is contacted with warehouse loading equipment or a fork lift. In some embodiments applying pressure to the protector plate can include sliding a rod of a slide rod assembly, wherein the slide rod assembly couples the protector plate to the door, and rotating a track of the slide rod assembly, which rotates the door open.

The foregoing and other features and advantages of the present invention will be apparent from the following more detailed description of the particular embodiments of the invention, as illustrated in the accompanying drawings.

DETAILED DESCRIPTION OF EMBODIMENTS OF THE INVENTION

As discussed above, embodiments of the present invention relate to a door guard that includes a protector plate which protects a door, and a support which is adapted to protect the door jam and hinges. The protector plate, which is hingedly coupled to the support, rotates in response to the opening of the door when force is applied to the door.

Figure 1:
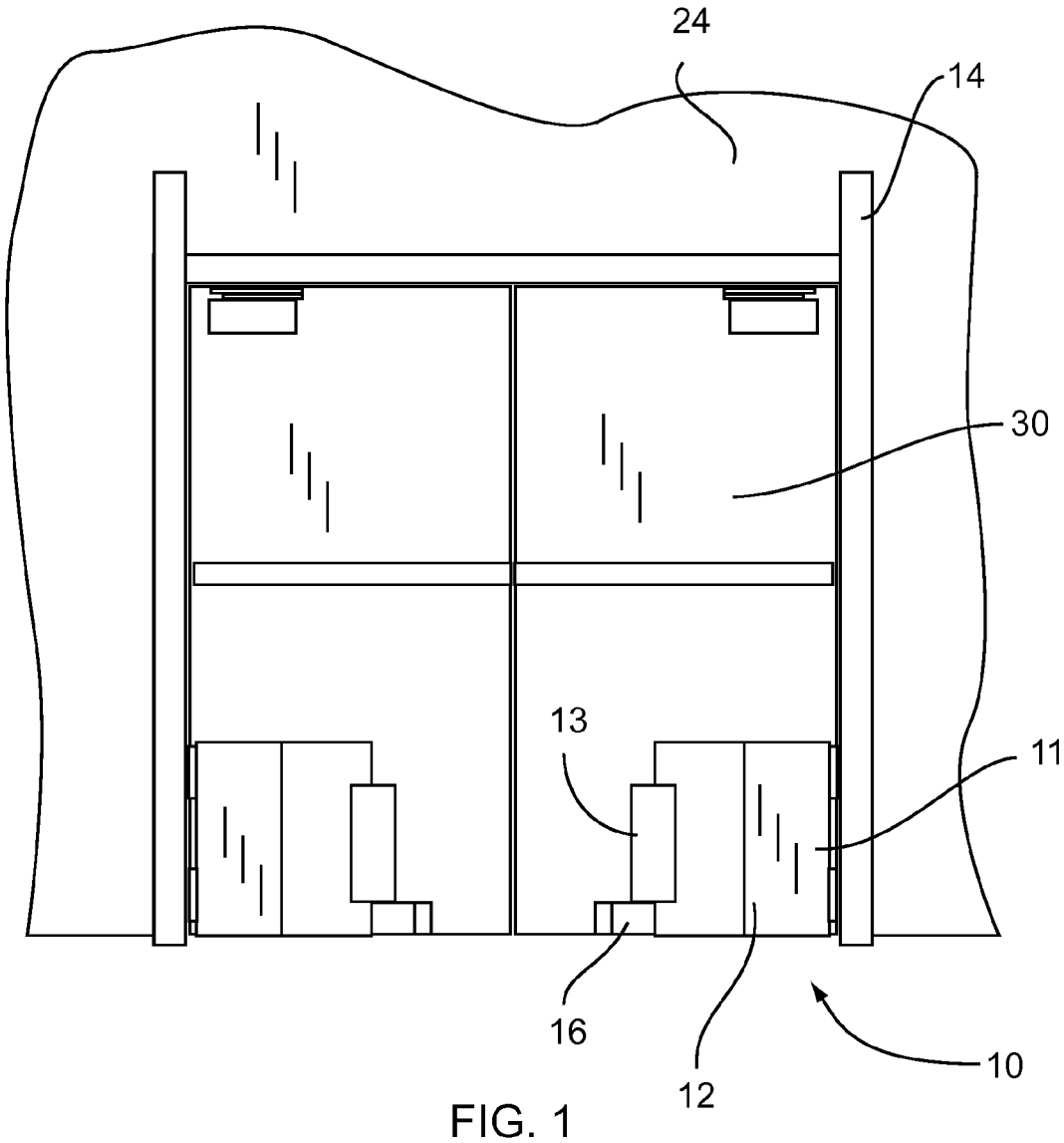
FIG. 1 is a perspective view of a door guard coupled to a door with the door in a closed position.
Figure 2:
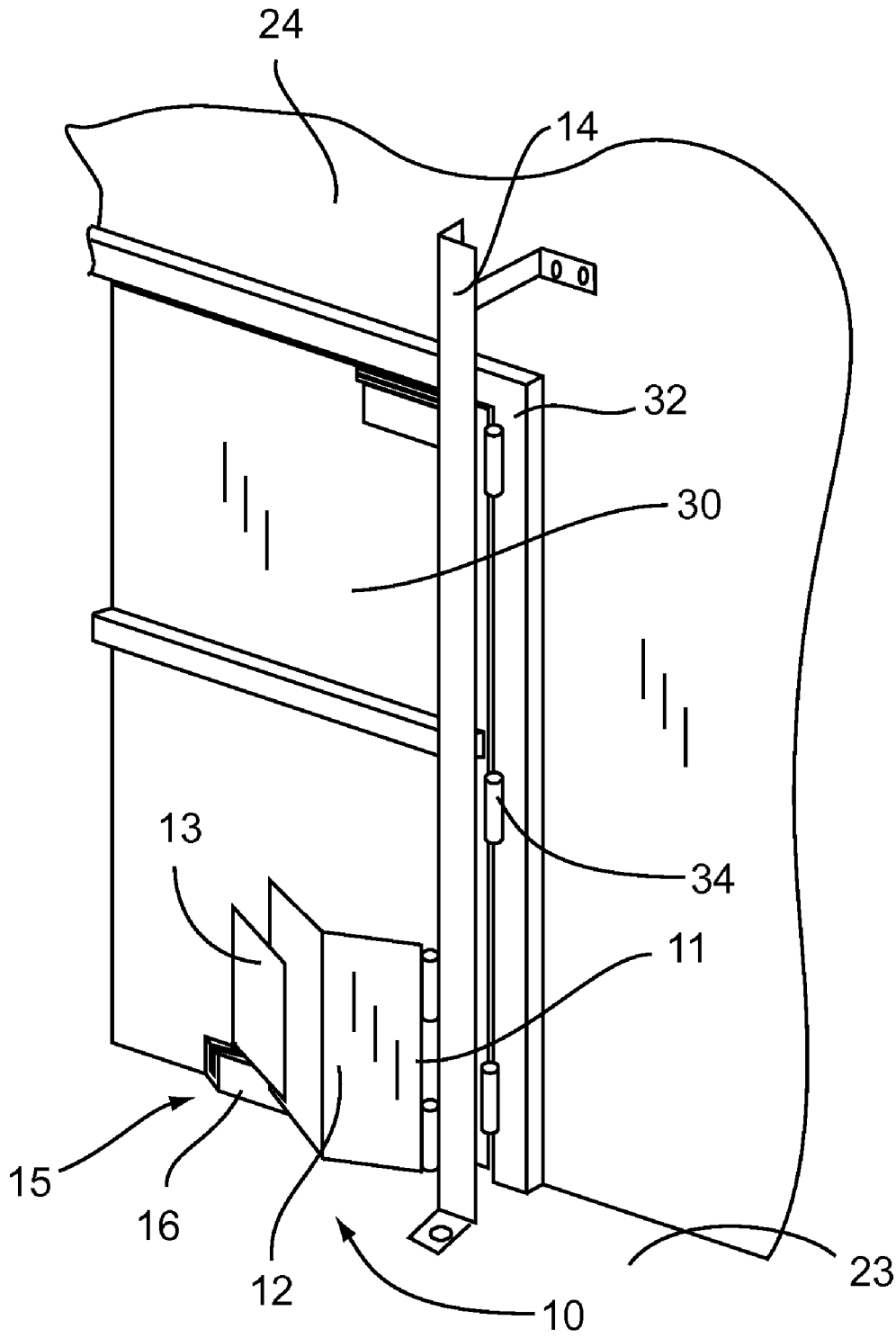
FIG. 2 is a perspective view of a door guard coupled to a door with the door in an opened position.
Figure 3:
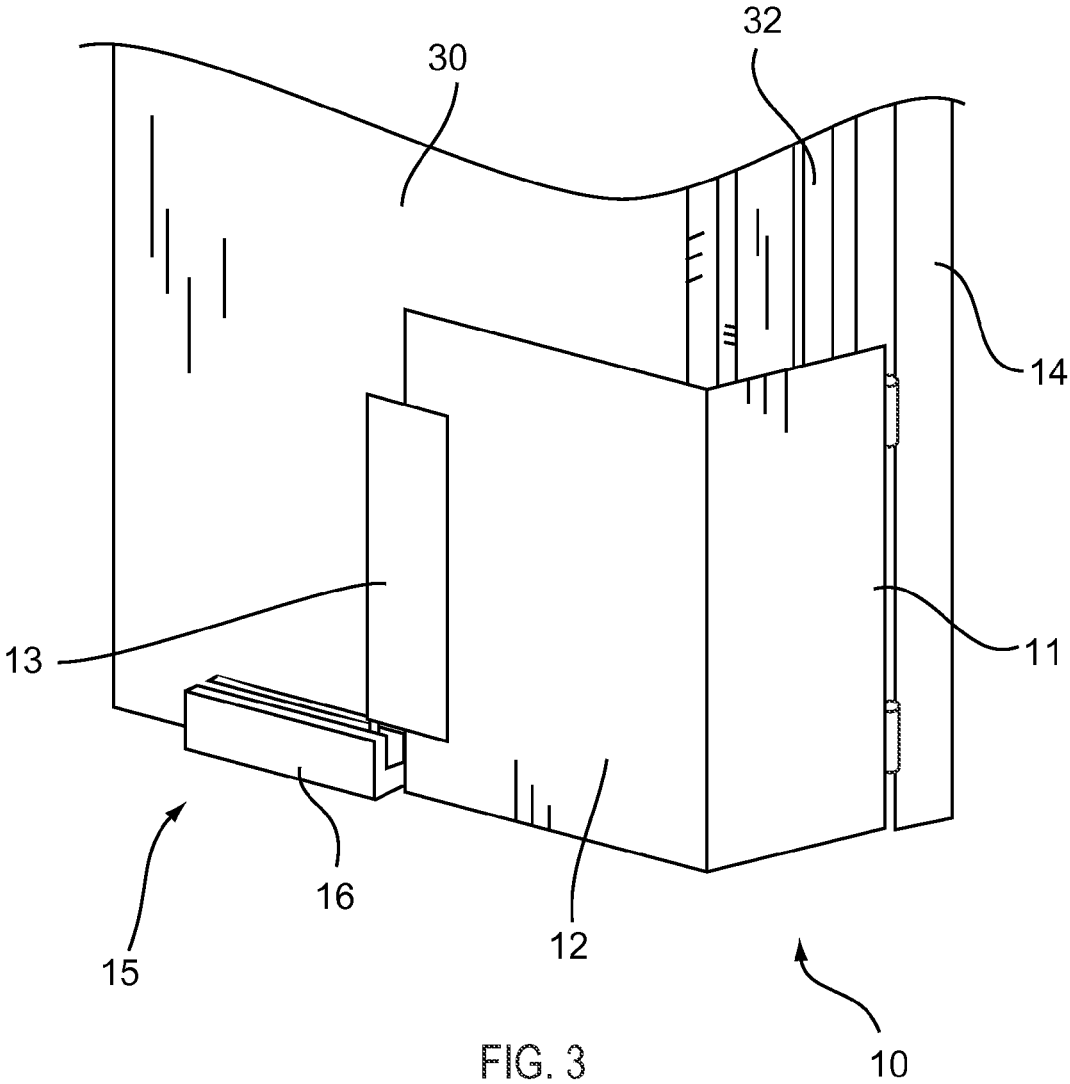
FIG. 3 is a perspective view of a door guard coupled to a door with the door in a closed position.

FIGS. 1-3 show particular embodiments of door guard 10 of the present invention. Door guard 10 includes protector plate 12, and support 14. A protector plate is an apparatus which is between a door and items that may come in contact with the door, protecting the door from damage. In the present embodiment protector plate 12 is a metal plate running partially across the bottom of door 30.

A support is an apparatus that supports the weight of protector plate 12. In this embodiment support 14 is a length of angle iron, not attached to door 30, running substantially vertically adjacent door 30 and mounted at one end to floor 23 and at the other end to wall 24 adjacent door 30. Support 14 protects door jam 32 and door hinges 34. This is accomplished by placing support 14 in a position alongside door 30 such that access to door jam 32 and door hinges 34 is blocked by support 14 for warehouse loading equipment such as a forklift. If a forklift is moving towards door jam 32 and door hinges 34, the forklift will come into contact with support 14 first, which is made to withstand the force of a forklift hitting it. In this way support 14 not only supports protector plate 12, but also protects door jam 32 and door hinges 34.

Protector plate 12 can include a first end 11 and a second end 13. First end 11 is coupled to support 14 and second end 13 is coupled to door 30. In the embodiment shown, first end 11 is hingedly coupled to an end of support 14 by use of hinge 20, which is adjacent door jam 32. In this embodiment protector plate 12 extends in a transverse direction from support 14, adjacent floor 23. The first end 11 of protector plate 12 protects door jam 32 and door hinge 34. The second end 13 of protector plate 12 protects door 30.

Figure 4:
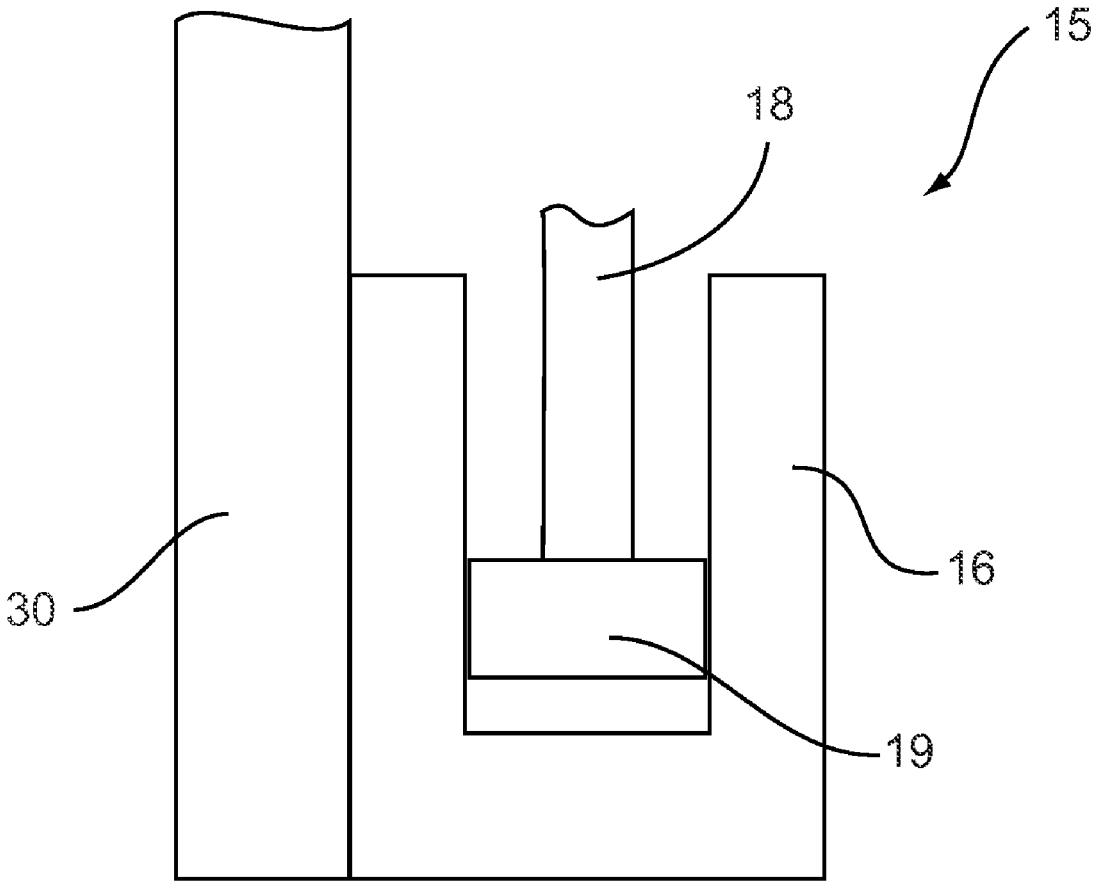
FIG. 4 is a perspective view of a slide mount assembly of a door guard.
Figure 5:
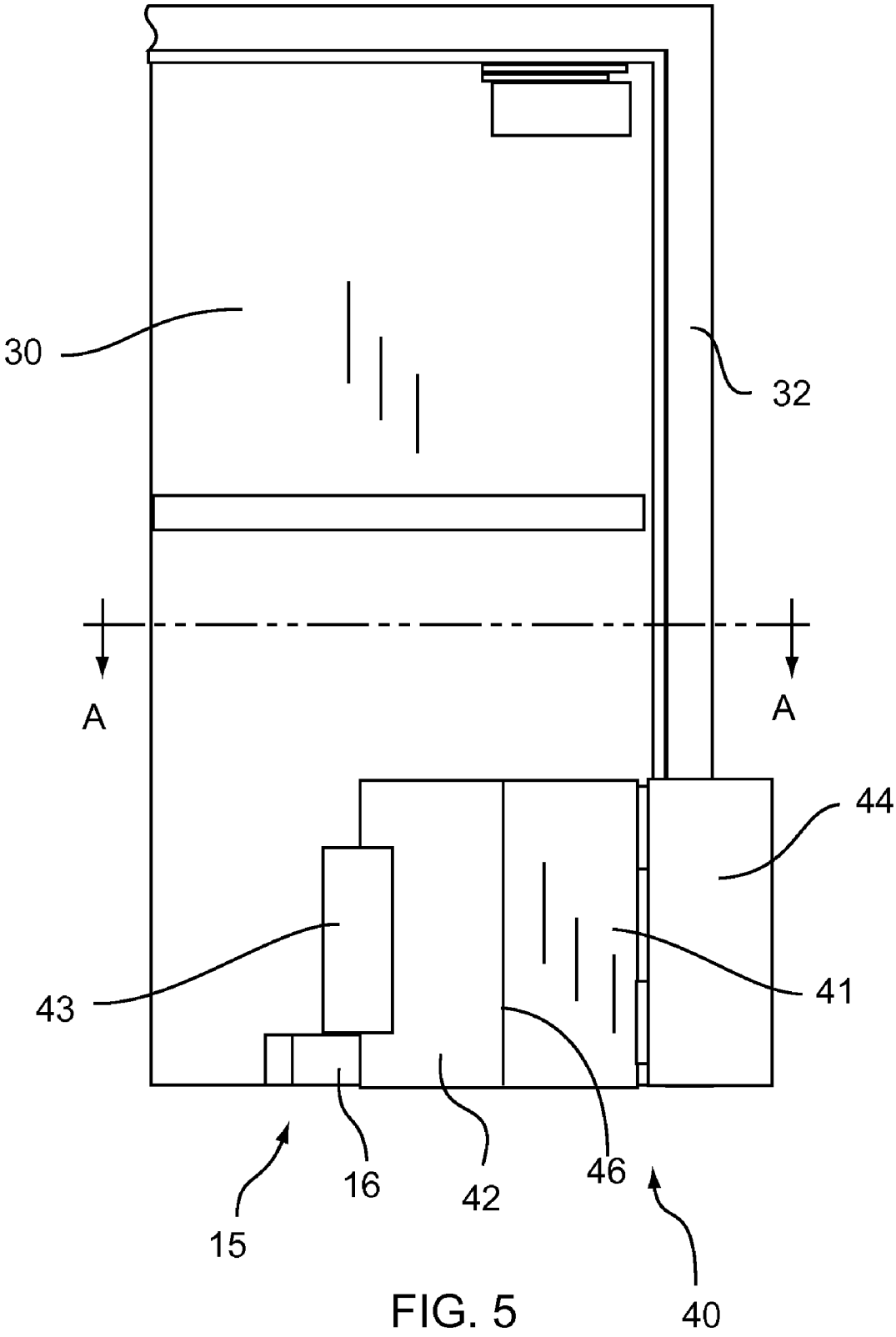
FIG. 5 is a front view of another door guard with a load directing support.
Figure 6:
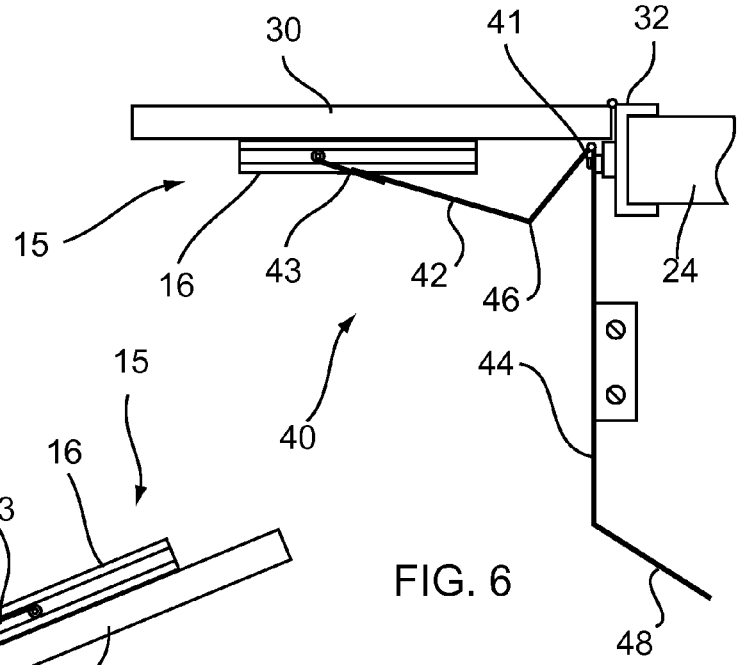
FIG. 6 is a section view of the door guard of FIG. 5 taken along line A-A.
Figure 7:
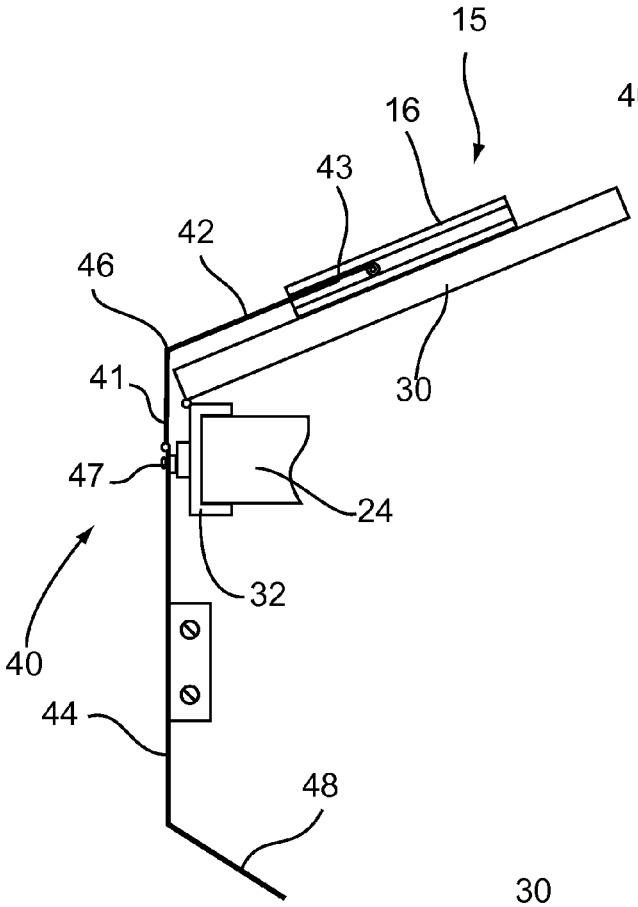
FIG. 7 is a section view of the door guard of FIG. 6 with a door rotated in an open position.

Protector plate 12 rotates in response to door 30 opening when force is applied to the door. The movement of protector plate 12 is accomplished by the means of attachment of protector plate 12 to door 30 and support 14. In this embodiment protector plate 12 is coupled to support 14 at end 11 with hinge 20, which allows rotation of protector plate 12. In this embodiment protector plate 12 is coupled to door 30 at end 13 with slide mount assembly 15. A slide mount assembly is an assembly which attaches protector plate 12 to door 30 such that protector plate 12 can slide across door 30 as door 30 opens and closes. In this embodiment, as shown in FIG. 4, slide mount assembly 15 includes track 16, slide rod 18, and roller 19. Track 16 is mounted to the bottom of door 30. Track 16 rotates with rotation of door 30 when opening and closing. Slide rod 18 is attached to second end 13 of protector plate 12 and moves across door 30 with protector plate second end 13. Slide rod 18 is coupled to track 16 with roller 19, which rolls in track 16 as second end 13 of protector plate 12 moves across door 30 as door 30 opens and closes. As track 16 rotates with rotation of door 30, track 16 engages slide rod 18 and causes slide rod 18 to move along track 16. The movement of slide rod 18 allows the protector plate to protect the most exposed portion of door 30 at all times and positions during opening of door 30.

When force is applied to door 30 as shown in either the closed or opened position, door 30 rotates. Track 16 rotates with door 30. Track 16 is coupled to slide rod 18 by roller 19. When track 16 rotates, roller 19 moves along track 16, moving slide rod 18 along door 30. Protector plate 12 moves with slide rod 18 because second end 13 of protector plate 12 is coupled to slide rod 18. Protector plate 12 rotates as track 16 rotates, with first end 11 of protector plate 12 rotating at hinge 20 attached to support 14, and second end 13 of protector plate 12 sliding along door 30 at slide rod 18 coupled to track 16 with roller 19. In this way protector plate 12 rotates in response to door 30 opening when force is applied to door 30. In this way protector plate 12 rotates in response to door 30 closing when force is applied to door 30.

In some embodiments, door 30 opens in response to rotation of protector plate 12 when force is applied to protector plate 12. When force is applied to protector plate 12 with door 30 in a closed position as shown in FIGS. 1 and 3, protector plate 12 rotates at hinge 20 attached to support 14 and first end of protector plate 11. Second end 13 of protector plate 12 is coupled to slide rod 18, which slides along door 30. Slide rod 18 is coupled to track 16 with roller 19. Roller 19 moves in track 16. Track 16 rotates as protector plate 12 rotates due to the coupling of second end 13 to track 16 thru slide rod 18 and roller 19. Rotation of track 16 causes door 30 to rotate open. In this way door 30 opens in response to rotation of protector plate 12 when force is applied to protector plate 12.

Support 14 may be coupled adjacent door jam 32. Support 14 is configured in this embodiment to support protector plate 12 such that protector plate 12 is positioned adjacent floor 23. Support 14 is adapted to protect door jam 32 and to further protect door hinges 34. In this way support 14 has three-fold functionality, to support protector plate 12, to protect door jam 32 and to protect door hinges 34.

Support 14 can be adapted in some embodiments to extend from floor 23 to the ceiling. In particular embodiments, support 14 is coupled to floor 23 on one end and to wall 24 on the other end, wherein support 14 extends beyond the height of door 30. Support 14 is coupled adjacent door jam 32 such that support 14 is substantially parallel to door jam 32. The coupling of support 14 on each end provides additional strength to support 14 in order to withstand impact forces that may be applied to support 14 from equipment used when going through the door.

While it is shown that support 14 is an angle iron, support 14 may be formed of any rigid material with sufficient strength to withstand a predetermined amount of impact force applied to it. The cross-sectional shape, while shown as an angle iron, may be any shape so long as support 14 performs its required functionality.

In some embodiments protector plate 12 may include bend 22. Bend 22 in protector plate 12 displaces protector plate 12 from door 30 when door 30 is closed, and also allows for sufficient space for a fork lift to pass through door 30. Bend 22 puts first end 11 of protector plate 12 and second end 13 of protector plate 12 in angled relationship to one another. Bend 22 allows first end 11 of protector plate 12 to be flush with door jam 32 when door 30 is in an open position, as shown in FIG. 2. In addition, bend 22 allows second end 13 of protector plate 12 to be flush with door 30 when door 30 is in an open position as shown in FIG. 2. Flush as used here means immediately adjacent to, with minimal space in between. This means that when door 30 is in an open position as shown in FIG. 2, first end 11 of protector plate 12 is immediately adjacent door jam 32, and second end 13 of protector plate 12 is immediately adjacent door 30. Thus, when door 30 is in an open position as shown in FIG. 2, protector plate 12 consumes minimal space around door 30 and door jam 32, allowing maximum space for warehouse equipment to move thru and around door 30. Bend 22 also allows slide rod 18 to operate properly within track 16 and further provides the proper connection between support 14 and track 16.

While protector plate 12 of door guard 10 may be used to protect door 30, protector plate 12 in particular embodiments may be utilized to open door 30 by use of particular equipment. For example, door 30 as shown in FIGS. 1 and 3 in a closed position shows protector plates 12 being readily accessible from one side of door 30. A fork lift (not shown), may carry a load and may contact protector plate 12. As the fork lift contacts protector plate 12 and continues to move toward door 30, pressure is applied to door 30 in a direction towards door 30. Protector plate 12 will rotate in response to this pressure. Slide rod 18 will slide in track 16 on roller 19 in response to the rotation of protector plate 12. The movement of slide rod 18 results in rotation of track 16. Due to the coupling of track 16 to door 30, door 30 rotates in response to rotation of track 16 and door 30 may be rotated to an opened position as shown in FIG. 2. In this way a fork lift is able to open door 30 by use of protector plate 12 of door guard 10.

Protector plate 12 may be of metal and may be of any size and shape in order to adequately protect the door to which it is coupled to. Depending on the size and type of door, the protector plate may be adapted in size to address the needs that are unique to the door it is being coupled to.

Particular embodiments of the door guard 10 may be utilized on various types of doors. For example, and without limitation, door guard 10 may used on overhead coiling doors, overhead section doors, manual or electric doors, high-speed doors, sliding type doors and the like. When utilized with an electric door, the present invention would require an interlock in order to operate properly.

FIGS. 5-8 show another particular embodiment of a door guard 40 of the present invention. Door guard 40 includes protector plate 42, and support 44. A protector plate is an apparatus which is between a door and items that may come in contact with the door, protecting the door from damage. In the present embodiment protector plate 42 is a metal plate running partially across the bottom of door 30.

A support is an apparatus that supports the weight of protector plate 42. In this embodiment support 44 is an elongate member, not attached to door 30, running substantially vertically adjacent door 30 and mounted at one end to the floor and at the other end to door jam 32 adjacent door 30. Support 44 protects door jam 32 and door hinges 34. Additionally, since the support 44 is coupled to the floor, the support 44 serves to secure the entire door jam and frame to the floor adding additional strength to the door jam and frame. This is accomplished by placing support 44 in a position alongside door 30 such that access to door jam 32 and door hinges 34 is blocked by support 44 for warehouse loading equipment such as a forklift. If a forklift is moving towards door jam 32 and door hinges 34, the forklift will come into contact with support 44 first, which is made to withstand the force of a forklift hitting it. In this way support 44 not only supports protector plate 42, but also protects door jam 32 and door hinges 34.

Protector plate 42 can include a first end 41 and a second end 43. First end 41 is coupled to support 44 and second end 43 is coupled to door 30. In the embodiment shown, first end 41 is hingedly coupled to an end of support 44 by use of hinge 20, which is adjacent door jam 32. In this embodiment protector plate 42 extends in a transverse direction from support 44, adjacent a floor. The first end 41 of protector plate 42 protects door jam 32 and door hinge 34. The second end 43 of protector plate 42 protects door 30.

Protector plate 42 rotates in response to door 30 opening when force is applied to the door. The movement of protector plate 42 is accomplished by the means of attachment of protector plate 42 to door 30 and support 44. In this embodiment protector plate 42 is coupled to support 44 at end 41 with a hinge, which allows rotation of protector plate 42. In this embodiment protector plate 42 is coupled to door 30 at end 43 with slide mount assembly 15. A slide mount assembly is an assembly which attaches protector plate 42 to door 30 such that protector plate 42 can slide across door 30 as door 30 opens and closes. In this embodiment, as shown in FIG. 4, slide mount assembly 15 includes track 16, slide rod 18, and roller 19. Track 16 is mounted to the bottom of door 30. Track 16 rotates with rotation of door 30 when opening and closing. Slide rod 18 is attached to second end 43 of protector plate 42 and moves across door 30 with protector plate second end 43. Slide rod 18 is coupled to track 16 with roller 19, which rolls in track 16 as second end 43 of protector plate 42 moves across door 30 as door 30 opens and closes. As track 16 rotates with rotation of door 30, track 16 engages slide rod 18 and causes slide rod 18 to move along track 16. The movement of slide rod 18 allows the protector plate to protect the most exposed portion of door 30 at all times and positions during opening of door 30.

When force is applied to door 30 as shown in either the closed or opened position, door 30 rotates. Track 16 rotates with door 30. Track 16 is coupled to slide rod 18 by roller 19. When track 16 rotates, roller 19 moves along track 16, moving slide rod 18 along door 30. Protector plate 42 moves with slide rod 18 because second end 43 of protector plate 42 is coupled to slide rod 18. Protector plate 42 rotates as track 16 rotates, with first end 41 of protector plate 42 rotating at hinge 20 attached to support 44, and second end 43 of protector plate 42 sliding along door 30 at slide rod 18 coupled to track 16 with roller 19. In this way protector plate 42 rotates in response to door 30 opening when force is applied to door 30. In this way protector plate 42 rotates in response to door 30 closing when force is applied to door 30.

In some embodiments, door 30 opens in response to rotation of protector plate 42 when force is applied to protector plate 42. When force is applied to protector plate 42 with door 30 in a closed, protector plate 42 rotates at hinge 20 attached to support 44 and first end of protector plate 41. Second end 43 of protector plate 42 is coupled to slide rod 18, which slides along door 30. Slide rod 18 is coupled to track 16 with roller 19. Roller 19 moves in track 16. Track 16 rotates as protector plate 42 rotates due to the coupling of second end 43 to track 16 thru slide rod 18 and roller 19. Rotation of track 16 causes door 30 to rotate open. In this way door 30 opens in response to rotation of protector plate 42 when force is applied to protector plate 42.

Support 44 may be coupled adjacent door jam 32. Support 44 is configured in this embodiment to support protector plate 42 such that protector plate 42 is positioned adjacent a floor. The support 44 is coupled to a floor and further coupled to a door jam using coupling 47. Support 44 is adapted to protect door jam 32 and to further protect door hinges 34. The support 44 further includes an angled portion 48. This angled portion serves to direct loads through the door way. In this way support 44 has a four-fold functionality, to support protector plate 42, to protect door jam 32, to protect door hinges 34 and direct loads through the door way.

Figure 8:
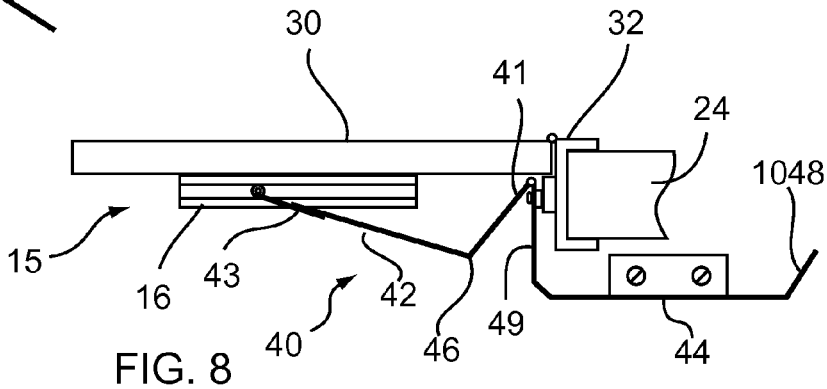
FIG. 8 is a section view of the door guard of FIG. 5 with a the load directing support in another configuration for a hall loading configuration.

In a particular embodiment shown in FIG. 8, the support 44 may have a different configuration, wherein the support 44 has a bend at the first end 49 and an angled portion 48 at a second end. The angled portion 48 directs loads away from the door jam 32 and the wall 24 and protects the hinges from contact in configurations of the door guard 40 used in a hall entrance to the door 30. The bend 49 further serves to direct loads through the doorway.

In some embodiments protector plate 42 may include bend 46. Bend 46 in protector plate 42 displaces protector plate 42 from door 30 when door 30 is closed, and also allows for sufficient space for a fork lift to pass through door 30. Bend 46 puts first end 41 of protector plate 42 and second end 43 of protector plate 42 in angled relationship to one another. Bend 46 allows first end 41 of protector plate 42 to be flush with door jam 32 when door 30 is in an open position. In addition, bend 46 allows second end 43 of protector plate 42 to be flush with door 30 when door 30 is in an open position. Flush as used here means immediately adjacent to, with minimal space in between. This means that when door 30 is in an open position, first end 41 of protector plate 42 is immediately adjacent door jam 32, and second end 43 of protector plate 42 is immediately adjacent door 30. Thus, when door 30 is in an open position, protector plate 42 consumes minimal space around door 30 and door jam 32, allowing maximum space for warehouse equipment to move thru and around door 30. Bend 46 also allows slide rod 18 to operate properly within track 16 and further provides the proper connection between support 44 and track 16.

While protector plate 42 of door guard 40 may be used to protect door 30, protector plate 42 in particular embodiments may be utilized to open door 30 by use of particular equipment. For example, door 30 in a closed position results in protector plate 42 being readily accessible from one side of door 30. A fork lift or other loading device such as a hand truck (not shown), may carry a load and may contact protector plate 42. As the fork lift contacts protector plate 42 and continues to move toward door 30, pressure is applied to door 30 in a direction towards door 30. Protector plate 42 will rotate in response to this pressure. Slide rod 18 will slide in track 16 on roller 19 in response to the rotation of protector plate 42. The movement of slide rod 18 results in rotation of track 16. Due to the coupling of track 16 to door 30, door 30 rotates in response to rotation of track 16 and door 30 may be rotated to an opened. In this way a fork lift is able to open door 30 by use of protector plate 42 of door guard 40.

Protector plate 42 may be of metal and may be of any size and shape in order to adequately protect the door to which it is coupled to. Depending on the size and type of door, the protector plate may be adapted in size to address the needs that are unique to the door it is being coupled to.

Figure 9:
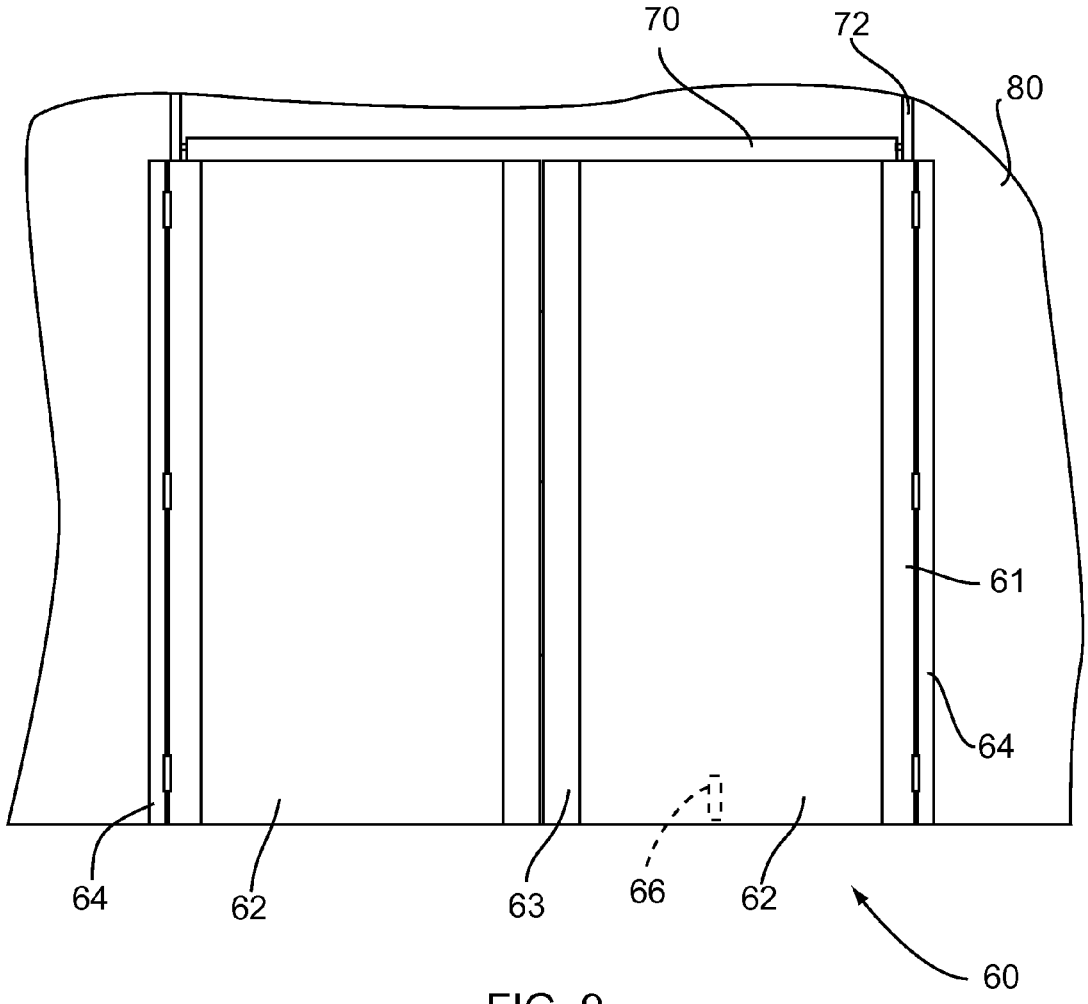
FIG. 9 is a front view of an embodiment of a door guard with an overhead door.
Figure 10:
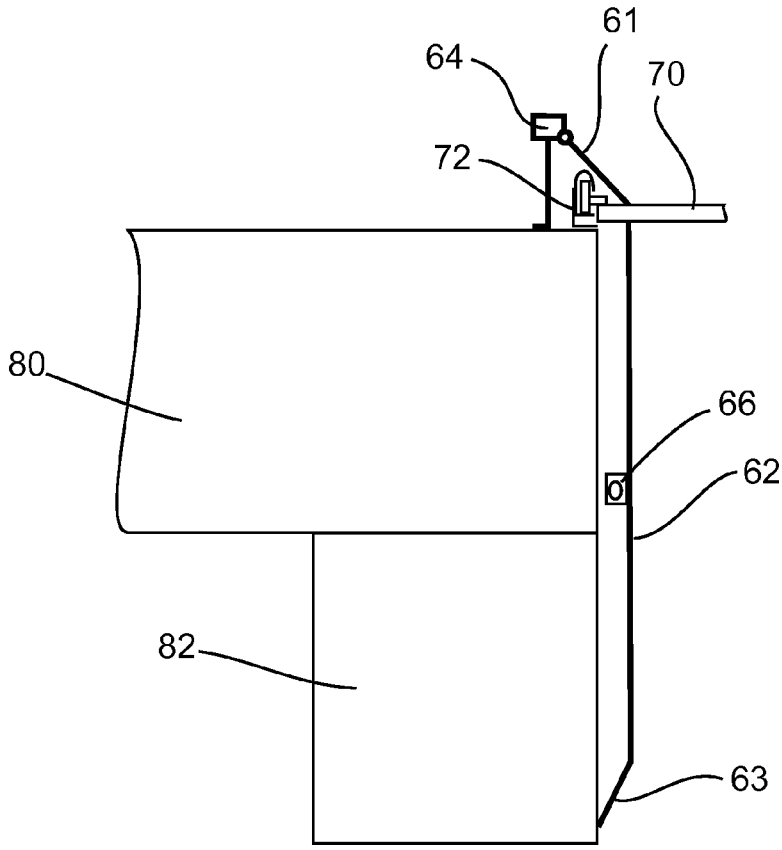
FIG. 10 is a section view of a door guard of FIG. 9 with the door guard rotated in an opened position.
Figure 11:
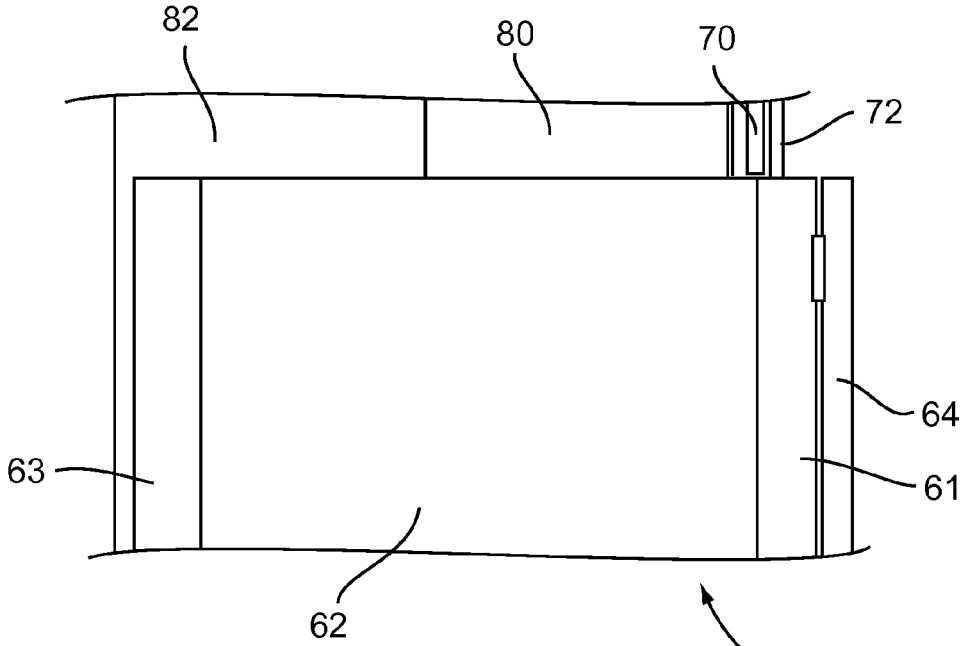
FIG. 11 is a side view of the door guard of FIG. 9 with the door guard rotated in an opened position.

Referring further to the drawings, FIGS. 9-11, another embodiment of the present invention includes a door guard 60 for use with an overhead door. The door guard 60 includes door guard 60 includes protector plate 62, and support 64. In the present embodiment protector plate 62 is a metal plate covering an overhead door 70.

A support is an apparatus that supports the weight of protector plate 62. In this embodiment support 64 is an elongate member running substantially vertically adjacent door track 72 and mounted at one end to floor and at the other end to wall 24 adjacent door 70. Support 64 protects the door track 70. This is accomplished by placing support 64 in a position alongside door 70 such that access to door track 72 is blocked by support 64 for warehouse loading equipment such as a forklift. If a forklift is moving towards door track 72 or overhead door 70, the forklift will come into contact with support 44 or protector plate 42 first, which is made to withstand the force of a forklift hitting it. In this way support 44 not only supports protector plate 42, but also protects the door track 72.

Protector plate 62 can include a first end 61 and a second end 63. First end 61 is coupled to support 64 and second end 63 is held in place by lock pin 66 coupled to a recess in the floor. In the embodiment shown, first end 61 is hingedly coupled to an end of support 64 by use of hinges, which is adjacent the door track 72, wherein the protector plate is rotatable between an opened and a closed position. In this embodiment protector plate 62 extends in a transverse direction from support 64, adjacent a floor. The first end 61 of protector plate 62 protects door track 72. The second end 63 of protector plate 62 protects door 70.

In a rotated opened position as shown in FIGS. 10 and 11, the protector plate 62 has the first end 61 covering the door track 72, the protector plate 62 covers a wall 80 and the second end 63 contacts a wall seal 82. The lock pin 66 may be locked in order to maintain the protector plate 62 in the opened position. When in the open position, the protector plate serves to protect the wall 80 and the door track 72. The protector plate 62 further supports the overhead door 70 and keeps the overhead door 70 from falling down the track 72. This further aids in the prevention of damaging the door 70 accidentally.

According to particular embodiments, the present invention may be used to protect the integrity of fire doors and enables the doors to seal and latch to work even after multiple hits by other objects. Additionally, the door guard may include built-in lamination in order to direct traffic through the doors in emergency situations such as fire egress. The door guard may also include indicia for signage.

Other embodiments of the present invention may include a method of opening a door. The method may include the steps of contacting a protector plate; applying pressure to the protector plate in a direction towards the door wherein the protector plate rotates in response; and continuing to apply pressure to the protector plate until the door is open to the desired position. According to the method may the step of contacting the protector plate may further comprise contacting the protector plate with warehouse loading equipment. Additionally, the contacting the protector plate may also comprise contacting the protector plate with a forklift. According to the method, the step of applying pressure includes sliding a rod of a slide rod assembly wherein the slide rod assembly couples the protector plate to the door; and rotating a track of the slide rod assembly wherein the door rotates open in response to rotation of the track.

It will be understood that the components defining an implementation of door guard 10 may be formed of any of many different types of materials or combinations thereof that can readily be formed into shaped objects provided that the components selected are consistent with the intended operation of door guard 10. For example, the components may be formed of: rubbers (synthetic and/or natural) and/or other like materials; glasses (such as fiberglass) carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Furthermore, the components defining door guard 10 may be purchased pre-manufactured or manufactured separately and then assembled together. However, any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components. Other possible steps might include sand blasting, polishing, powder coating, zinc plating, anodizing, hard anodizing, and/or painting the components, for example.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims. For example, slide mount assembly can take other forms, including a track and roller imbedded in the door instead of attached to the door.

The invention claimed is:

1. A door guard comprising:

a support for protecting a door jam and a door hinge; and a protector plate for protecting a door;

wherein the protector plate is hingedly coupled to the support;

wherein the protector plate rotates in response to the door opening when force is applied to the door; and a slide mount assembly, wherein the slide mount assembly slideably couples the protector plate to the door.

2. The door guard of claim 1, wherein the door opens in response to rotation of the protector plate when force is applied to the protector plate.

3. The door guard of claim 1, wherein the support is coupled to a floor at one end and the support is coupled to a wall at another end.

4. The door guard of claim 1, wherein the support is coupled to the floor and to the door jam.

5. The door guard of claim 4, wherein the support comprises an angled portion to direct loads through a doorway.

6. The door guard of claim 1, wherein the slide mount assembly comprises:

a slide rod coupled to the protector plate;

a track coupled to the door; and a roller, wherein the roller couples the slide rod to the track.

7. A door guard comprising:

a protector plate with a first end and a second end;

a support, wherein the first end of the protector plate is coupled to the support and the second end of the protector plate is coupled to a door; and a slide mount assembly which slideably couples the second end of the protector plate to the door.

8. The door guard of claim 7, wherein the first end of the protector plate protects a door jam and a door hinge, and the second end of the protector plate protects the door.

9. The door guard of claim 8, wherein the protector plate rotates in response to the door opening when force is applied to the door.

10. The door guard of claim 8, wherein the door opens in response to rotation of the protector plate when force is applied to the protector plate.

11. The door guard of claim 7, wherein the first end of the protector plate and the second end of the protector plate are formed in angled relationship to one another wherein the first end is flush with the door jam when the door is in an open position and the second end is flush with the door when the door is in an open position.

12. The door guard of claim 7, wherein the support is coupled adjacent a door jam.

13. The door guard of claim 7, wherein the protector plate is adjacent a floor.

14. The door guard of claim 7, wherein the first end of the protector plate is hingedly coupled to the support.

15. The door guard of claim 7, wherein the slide mount assembly comprises:

a slide rod coupled to the protector plate;

a track coupled to the door; and a roller, wherein the roller couples the slide rod to the track.

16. The door guard of claim 7, wherein the protector plate extends in a substantially transverse direction from the support.

* * * * *